US009162837B2

(12) United States Patent
Sugiyama

(10) Patent No.: US 9,162,837 B2
(45) Date of Patent: Oct. 20, 2015

(54) SHEET SUPPLY DEVICE AND IMAGE FORMING APPARATUS

(71) Applicant: KYOCERA Document Solutions Inc., Osaka (JP)

(72) Inventor: Tsukasa Sugiyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/468,162

(22) Filed: Aug. 25, 2014

(65) Prior Publication Data

US 2015/0061212 A1 Mar. 5, 2015

(30) Foreign Application Priority Data

Aug. 30, 2013 (JP) ..... 2013-179026

(51) Int. Cl.

| | |
|---|---|
| ***B65H 7/04*** | (2006.01) |
| ***B65H 1/14*** | (2006.01) |
| ***B65H 7/02*** | (2006.01) |
| ***G03G 15/00*** | (2006.01) |
| ***B65H 1/04*** | (2006.01) |
| ***B65H 7/18*** | (2006.01) |

(52) U.S. Cl.

CPC .. *B65H 7/02* (2013.01); *B65H 1/04* (2013.01); *B65H 1/14* (2013.01); *B65H 7/04* (2013.01); *B65H 7/18* (2013.01); *G03G 15/553* (2013.01); *G03G 15/6502* (2013.01); *B65H 2511/20* (2013.01); *B65H 2511/30* (2013.01); *B65H 2513/10* (2013.01); *G03G 2215/00556* (2013.01)

(58) Field of Classification Search

CPC ..... B65H 7/04; B65H 7/14; B65H 7/18; B65H 7/20; B65H 7/02; B65H 1/14; B65H 1/12; B65H 1/18; B65H 1/04

See application file for complete search history.

(56) References Cited

U.S. PATENT DOCUMENTS 8,565,664 B2 * 10/2013 Yamauchi et al. ..... 399/393

FOREIGN PATENT DOCUMENTS

| | | | |
|---|---|---|---|
| JP | 63057455 A | * | 3/1988 |
| JP | 10-139191 A | | 5/1998 |
| JP | 2004-323197 A | | 11/2004 |
| JP | 2011-20854 A | | 2/2011 |

* cited by examiner

*Primary Examiner* — Luis A Gonzalez

(74) *Attorney, Agent, or Firm* — Stein IP, LLC

(57) ABSTRACT

The first remaining amount holding unit stores the remaining amount of sheet detected by the remaining amount detection unit before a sheet adding operation to the sheet stacking surface. The second remaining amount holding unit stores the remaining amount of sheet detected by the remaining amount detection unit after the sheet adding operation to the sheet stacking surface. The determination unit determines a sheet adding position based on the respective remaining amount of sheet stored in the first remaining amount holding unit and the second remaining amount holding unit. The feeding speed control unit changes a sheet feeding speed of the pickup roller based on the sheet adding position determined by the determination unit and the sheet remaining amount detected by the remaining amount detection unit.

4 Claims, 5 Drawing Sheets

| BEFORE TRAY IS PULLED OUT | AFTER TRAY IS MOUNTED | PAPER ADDING POSITION |
|---|---|---|
| NO PAPER | NO PAPER | NONE |
| | LEVEL 1 | NONE |
| | LEVEL 2 | NONE |
| LEVEL 1 | NO PAPER | NONE |
| | LEVEL 1 | LEVEL 1 |
| | LEVEL 2 | LEVEL 1 |
| LEVEL 2 | NO PAPER | NONE |
| | LEVEL 1 | NONE |
| | LEVEL 2 | LEVEL 2 |

SHEET SUPPLY DEVICE AND IMAGE FORMING APPARATUS

CROSS-REFERENCE TO RELATED APPLICATIONS

This application claims the benefit of Japanese Patent Application No. 2013-179026 filed on Aug. 30, 2013, all of which is hereby incorporated by reference in its entirety.

BACKGROUND OF THE INVENTION

1. Field of the Invention

The present disclosure relates to a sheet supply device for supplying a sheet like a paper, and an image forming apparatus.

2. Description of the Related Art

Sheet supply devices are widely used by the image forming apparatus like copying machines, facsimile machines, scanners, and multifunction apparatus. Using the sheet supply device, the sheets like papers to which an original image is transferred are conveyed one by one to a position to form the image thereon, whereby the image forming apparatus can print each image successively.

It is configured in the sheet supply device that a sheet bundle is allowed to touch a pickup roller, in order that a plurality of sheets stacked onto a tray is fed one by one. A thickness of sheet bundle depends on the number of sheets stacked on the tray. Accordingly, a distance between a sheet stacking surface and the pickup roller should be adjusted according to the thickness of sheet bundle, in order to allow the sheet bundle to properly touch the pickup roller. A lifting plate liftably mounted to the sheet stacking surface can be used for such adjustment. In the sheet supply device, the sheet bundle on the lifting plate is pushed up by the lifting plate, and the sheet bundle is allowed to touch the pickup roller, and then the sheet touching the pickup roller is sent out one by one.

In the above sheet supply device, when the temperature or moisture environment changes in the image forming apparatus or when members are worn out by use, there is a possibility that sheet feeding troubles like no paper feeding and double feeding occurs due to the change of the ideal conditions for feeding the sheets. As the apparatus that has settled such problem, there is an image forming apparatus wherein the speed of the pickup roller is adjusted based on a comparison result between a conveyance time for conveying a preceding sheet and a standard conveyance time recorded in advance. In this image forming apparatus, when the sheet conveyance time gets long due to the occurrence of skid, the skid of a following sheet can be suppressed by reducing the speed of the pickup roller.

It sometimes occurs that user of the image forming apparatus wishes to use a different kind of sheet instead of the sheets set in the sheet supply device. At this time, he uses his desired sheets without replace all the sheets set in the sheet supply device with his desired sheets but adding his desired sheets to the sheets set in the sheet supply device. In order not to include his undesired sheet in the output sheets on such condition, there is an image forming apparatus wherein the added sheets and the preset sheets are managed separately.

When all the sheets on the tray are sent out by the sheet conveying, a sheet set sensor for detecting the sheets on the tray does not detect any sheets (a detection state of no sheet), and the sheets must be set. In the latest image forming apparatus, when the state of no sheet is detected, the user is not requested to set the sheets, but a display provided to the apparatus displays a remaining amount of sheet. In some of those apparatus, when the remaining amount of sheets gets small, the display displays a warning message to draw an attention from the user. By promoting the user to set the sheets just before the state of no sheet, the running-out of sheets can be prevented in the middle of the job processing.

As described above, in case of the image forming apparatus for promoting the user to set the sheets just before the state of no sheet, the user confirms the message and sets the same kind of sheets as necessary. In this case, if the sheet bundle is remaining on the tray, it occurs that another sheet bundle is added on the remained sheet bundle in such state. In case of such sheet addition, an air layer is produced at a paper adding position, that is, a position between a highest surface of the remaining sheet bundle and an undermost surface of the added sheet bundle. The frictional force between those surfaces becomes small as compared with the frictional force between the adjacent sheets. Therefore, when the sheet near and on the paper adding position is sent out, it sometimes occurs that one sheet is not fed out, but plural sheets on the paper adding position are separated from the paper adding position, and they are sent out by the pickup roller. In this case, the feeding failure occurs.

The feeding failure cannot be eliminated even if the foregoing method for adjusting the speed of the pickup roller is applied, because the preceding sheet has been fed normally. In case of the method for managing the added sheets and the preset sheets separately, the paper adding position can be managed, but the occurrence of the feeding failure cannot be recognized, and the feeding trouble cannot be settled. Moreover, the method of managing the added sheets separately assumes that the different kind of sheet is added, and it is not configured so as to separately manage the same kind of sheet, therefore it is difficult to use the method.

SUMMARY OF THE INVENTION

A sheet supply device in the present disclosure includes a pickup roller, a remaining amount detection unit, a first remaining amount holding unit, a second remaining amount holding unit, a determination unit, and a feeding speed control unit. The pickup roller is placed above a sheet stacking surface for loading plural sheets thereon, and feeds the sheet with touching an upper surface of the sheets loaded on the sheet stacking surface. The remaining amount detection unit detects a remaining amount of sheet loaded on the sheet stacking surface. The first remaining amount holding unit stores the remaining amount of sheet detected by the remaining amount detection unit before an operation for adding the sheets on the sheet stacking surface. The second remaining amount holding unit stores the remaining amount of sheet detected by the remaining amount detection unit after the operation for adding the sheets on the sheet stacking surface. The determination unit determines a sheet adding position based on the respective remaining amount of sheet stored in the first remaining amount holding unit and the second remaining amount holding unit. The a feeding speed control unit for changing a sheet feeding speed of the pickup roller based on the sheet adding position determined by the determination unit and the sheet remaining amount detected by the remaining amount detection unit.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

The embodiment of the present disclosure will be more specifically explained hereinafter according to the attached drawings. The present disclosure is materialized by a digital multifunction peripheral.

Figure 1:
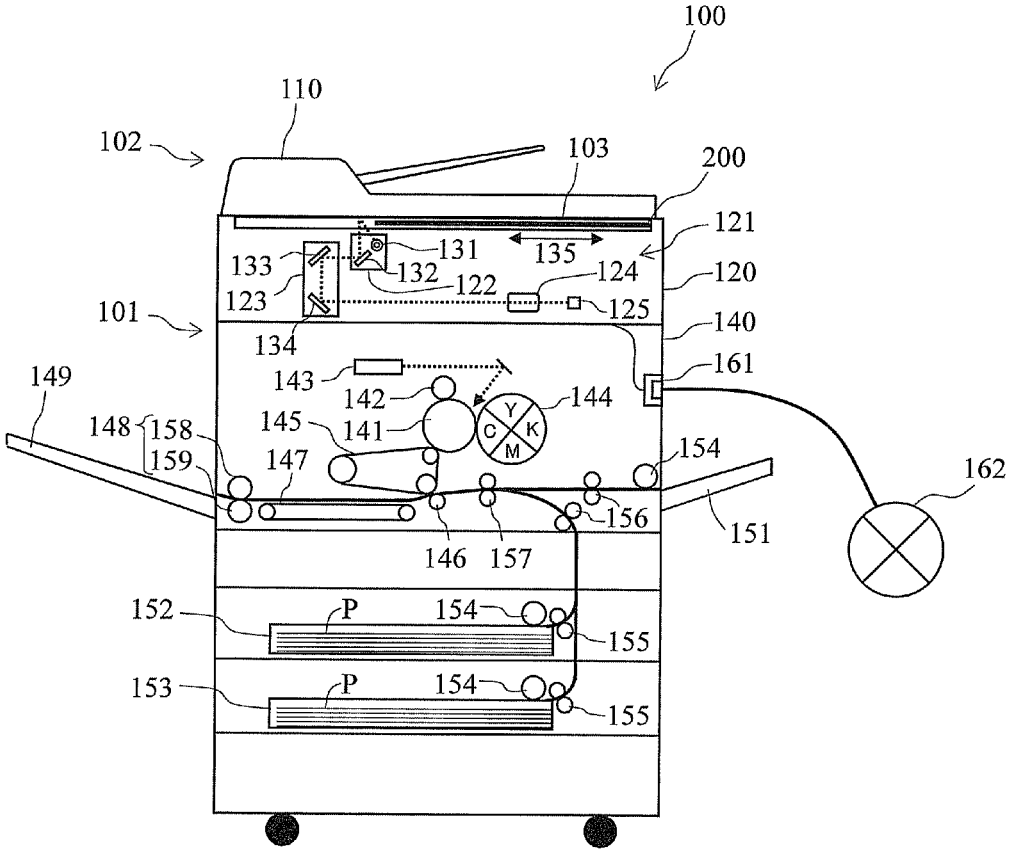
FIG. 1 is a schematic view showing a whole structure of a multifunction peripheral in accordance with an embodiment of the present disclosure.

FIG. 1 is a schematic view showing the whole structure of the digital multifunction peripheral in this embodiment. As shown in FIG. 1, the multifunction peripheral 100 includes a base machine 101 having an image reading unit 120 and an image forming unit 140, and a platen cover 102 placed over the base machine 101. An original plate 103 is arranged on a top surface of the base machine 101. The original plate 103 is opened and closed by the platen cover 102. The platen cover 102 is provided with a document feeder 110. The multifunction peripheral 100 is provided on its front side with an operation panel 200 whereby user can give the multifunction peripheral 100 a copy start instruction and other instructions, and also confirm a status or setting of the multifunction peripheral 100.

The image reading unit 120 is disposed below the original plate 103. The image reading unit 120 reads an image of an original by a scanning optical system 121, and creates digital data (image data) of the image. The original can be placed on the original plate 103 or the document feeder 110. The scanning optical system 121 includes a first carriage 122 and a second carriage 123, and a condenser lens 124. The first carriage 122 is provided with a linear light source 131 and a mirror 132, and the second carriage 123 is provided with mirrors 133 and 134. The light source 131 illuminates the original. The mirrors 132, 133 and 134 guide the light reflected from the original to the condenser lens 124, and the condenser lens 124 forms a light image on a light receiving surface of a line image sensor 125.

In the scanning optical system 121, the first carriage 122 and the second carriage 123 are mounted so as to reciprocate in a sub scanning direction 135. The image sensor 125 can read the image of the original placed on the original plate 103 by moving the first carriage 122 and the second carriage 123 in the sub scanning direction 135. In case of reading the image of the original placed on the document feeder 110, the image reading unit 120 temporarily stops the first carriage 122 and the second carriage 123 so as to correspond to an image reading position, and then reads the image of the original passing through the image reading position by the image sensor 125. The image sensor 125 creates the image data of the original corresponding to each color component of R (red), G (green), and B (blue) from the light image incident to the light receiving surface, for example. The created image data can be printed out on the paper by the image forming unit 140. The image data also can be sent to other devices (not show in the drawing) from network interface 161 via network 162.

The image forming unit 140 prints out on papers the image data obtained by the imager reading unit 120 or the image data received from the other device connected with the network 162. The image forming unit 140 is provided with a photosensitive drum 141. The photosensitive drum 141 rotates at a specific speed in one direction. A charging unit 142, an exposing unit 143, a developing unit 144, and an intermediate transfer belt 145 are arranged around the photosensitive drum 141 successively from an upstream side of the rotating direction of the photosensitive drum 141. The charging unit 142 uniformly electrifies a surface of the photosensitive drum 141. The exposing unit 143 radiates light on the surface of the photosensitive drum 141 according to the image data, and forms an electrostatic latent image on the photosensitive drum 141. The developing unit 144 adhere toners to the electrostatic latent image and forms a toner image on the photosensitive drum 141. The intermediate transfer belt 145 transfers the toner image formed on the photosensitive drum 141 to the paper. When the image data is a color image, the intermediate transfer belt 145 transfers each color of the toner image to a same paper. The RGB form of color image is converted to the image data in a form of C (cyan), M (magenta), Y (yellow), and K (black), and each color component of the image data is inputted to the exposing unit 143.

The image forming unit 140 feeds a paper from a manual paper feed tray 151 or paper supply device 152 and 153 to a transfer unit between the intermediate transfer belt 145 and a transfer roller 146. The various size of papers can be placed on the manual paper feed tray 151 or be accommodated in the paper supply device 152 and 153. The image forming unit 140 selects the paper specified by user or the paper corresponding to a size of original detected automatically, and then feeds the selected paper from the manual paper feed tray 151 or the paper supply device 152 or 153 by a pickup roller 154. The supplied paper is conveyed to the transfer unit by a conveyance roller 155, 156 and a resist roller 157. The paper on which the toner image is transferred is conveyed to a fixing device 148 by a conveyance belt 147. The fixing device 148 has a fixing roller 158 including a heater, and a pressure roller 159, and the toner image is fixed on the paper by the heat and the pressure. The image forming unit 140 ejects the paper passing through the fixing device 148 to a copy receiving tray 149.

Figure 2A:
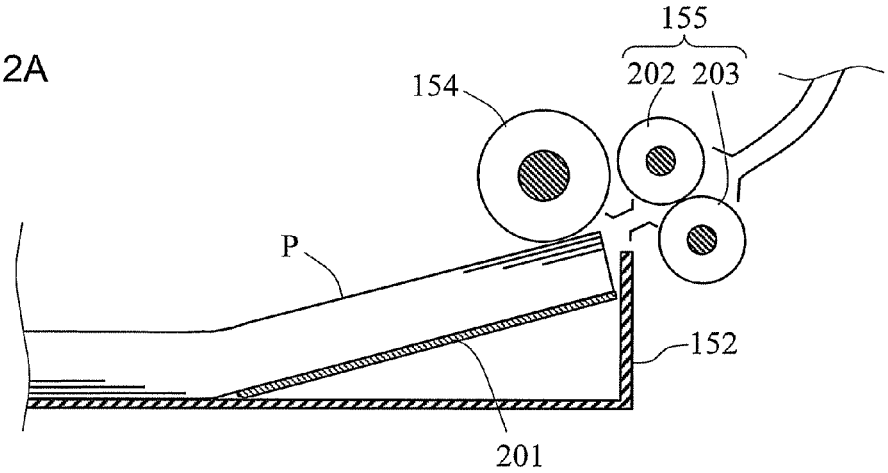
FIG. 2A, FIG. 2B, FIG. 2C and FIG. 2D are enlarged views of a main part of the multifunction peripheral in accordance with an embodiment of the present disclosure.
Figure 2B:
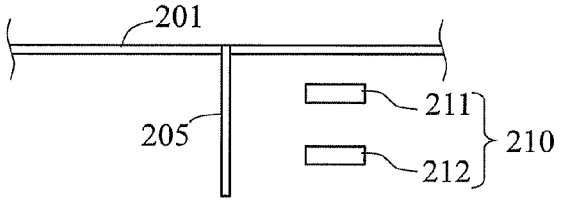
Figure 2C:
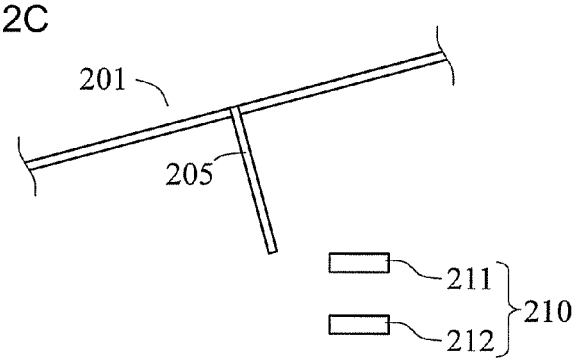
Figure 2D:
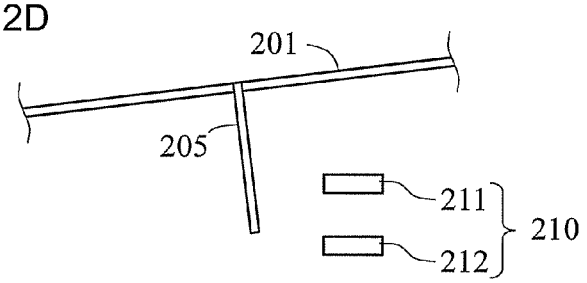

The structure of the paper supply device 152 and 153 is explained hereinafter based on the paper supply device 152. The paper supply device 152 can accommodate papers P (a paper bundle) therein. The paper bundle is loaded on a lifting plate liftably mounted to the paper supply device 152. FIG. 2A to FIG. 2D are enlarged views of a main part of the paper supply device 152. FIG. 2A is the enlarged view of the part near to the pickup roller 154. FIG. 2B to FIG. 2D are a view showing a paper remaining amount detection unit utilizing the up and down moving of the lifting plate.

As shown in FIG. 2A, the lifting plate 201 is brought near to a side of the pickup roller 154 and placed on a bottom (a sheet stacking surface) inside the paper supply device 152. The lifting plate 201 is disposed over a width direction (a direction perpendicular to the paper feeding direction) of the paper supply device 152. In a longitudinal direction (the paper feeding direction) of the paper supply device 152, the lifting plate 201 is disposed over a specific distance from the side of the pickup roller 154 (a half of length of the longitudinal direction of the paper supply device). In respect of ends of the lifting plate 201, one end far from the pickup roller 154 is supported by the bottom of the paper supply device 152 in a state that the end is rotatable around a rotation axis parallel to the width direction of the paper supply device 152, and the other end is biased toward the pickup roller 154, that is, upwardly by a bias means not shown. In this structure, an end of the paper bundle P on the lifting plate 201, the end at the side of the pickup roller 154, moves up and the highest paper of the paper bundle touches the pickup roller 154. The pickup roller 154 feeds the touched paper to a downstream side.

As shown in FIG. 2A, on the downstream side of the pickup roller 154, a conveyance roller 155 composed of a feed roller 202 and a separation roller 203 is disposed. When more than two papers are fed, the conveyance roller 155 separates one paper from them by the feed roller 155 and the separation roller 203 and feeds it to the downstream side.

The remaining amount of paper on the lifting plate 201 is detected by a paper remaining amount detection unit 210. In this embodiment, a structure of the paper remaining detecting unit 210 having a low resolution is employed for convenience of explanation of the principle of the present disclosure, but it is possible to apply any well-known structure to the paper remaining amount detection unit 210.

As shown in FIG. 2B, the paper remaining amount detection unit 210 is configured that reflective type photo sensors (photo reflectors) 211 and 212, each sensor having a light emitting unit and a light receiving unit on the same surface, are aligned vertically. Besides, the paper remaining amount detection unit 210 may be configured using the other contactless sensor such as transmissive photo sensors (photo interrupters) on which the light emitting unit is disposed facing the light receiving unit, or the contact type sensor such as microswitches. It is not limited in particular, the paper remaining amount detection unit 210 is disposed at an end of the width direction of the paper supply device 152, and a reflection member 205 of which end is fixed to the lifting plate 201 is disposed facing to the light emitting units of the reflective photo sensor 211 and 212.

The reflection member 205 is on a position that the reflection member 205 faces all the reflective type photo sensors 211 and 212 when the paper bundle is fully loaded on the lifting plate 201, as shown in FIG. 2B. The reflection member 205 moves up when there are no papers on the lifting plate 201, as shown in FIG. 2C, and be on the position that the reflection member 205 does not face the reflective type photo sensors 211 and 212. Specifically, the reflective type photo sensor 212 (and 211) is ON (a state detecting the reflective light) when the paper bundle is fully loaded. When there are no papers, the reflective type photo sensor 211 (and 212) is OFF (a state detecting no reflective light). When the paper bundle is half loaded, the reflective type photo sensor 211 is ON (the reflective type photo sensor 212 is OFF), as shown in FIG. 2D. Besides, when the reflective type photo sensor 211 is OFF, the multifunction peripheral 100 recognizes the state of no paper and prohibits the image forming processing using the paper in the paper supply device till the papers are added.

The remaining amount of paper detected by the paper remaining amount detection unit 210 is displayed on a display provided to the operation panel 200. The user that recognized the remaining amount of paper adds the papers, as needed. In this embodiment, the paper supply device 152 is configured that a tray for accommodating the papers is pulled toward the front side of the multifunction peripheral 100. The user pulls out the paper tray to which the papers are added, and then adds the papers. The paper tray 100 to which the papers were added is mounted to the multifunction peripheral 100.

Figure 3:
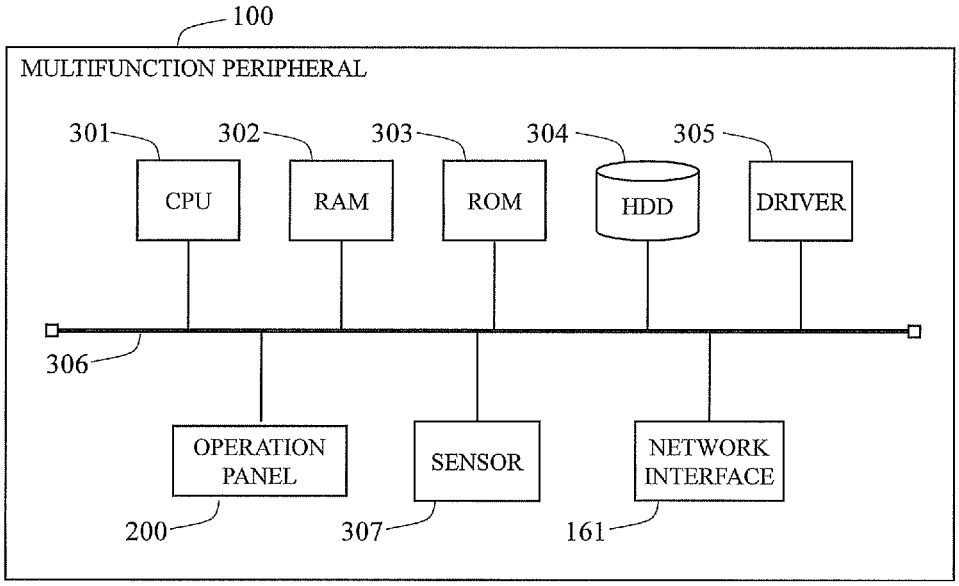
FIG. 3 is a hardware block diagram of the multifunction peripheral in accordance with an embodiment of the present disclosure.

FIG. 3 is a hardware block diagram of control units for the multifunction peripheral. In the multifunction peripheral 100 in this embodiment, CPU (Central Processing Unit) 301, RAM (Random Access Memory) 302, ROM (Read Only Memory) 303, HDD (Hard Disk Drive) 304, and a driver 205 corresponding to driving units of the document feeder 110, the image reading unit 120, and the image forming unit 140 are connected via an internal path 306. ROM 303 and HDD 304 stores programs, and CPU 301 controls the multifunction peripheral 100 according to instructions from the control programs. For instance, CPU 301 uses RAM 302 as a working area, and sends and receives the instruction and the data from and to the driver 305, whereby the working of each driving unit can be controlled. HDD 304 is also used for storing the image data received from the outside devise via network interface 161.

The internal path 306 is also connected with the operation panel 200 and various sensors 307. The operation panel 200 receives the user operation, and supplies a signal based on the operation to CPU 301. The operation panel 200 displays an operation screen on a display provide to the operation panel 200 according to the control signal from CPU 301. The sensor 307 includes various sensors, such as an open and shut detecting sensor for detecting the opening and the shutting of the platen cover 102, an original detecting sensor for detecting an original on the original plate 103, a temperature detecting sensor for detecting the temperature of the fixing device 148, a paper detecting sensor for detecting the paper or the original to be conveyed, and so on. CPU 301 executes the programs stored in ROM 303, whereby the following means (functional blocks) can be realized and it is possible to control the working of each means according to the signals from these sensors.

Figures 4, 5:
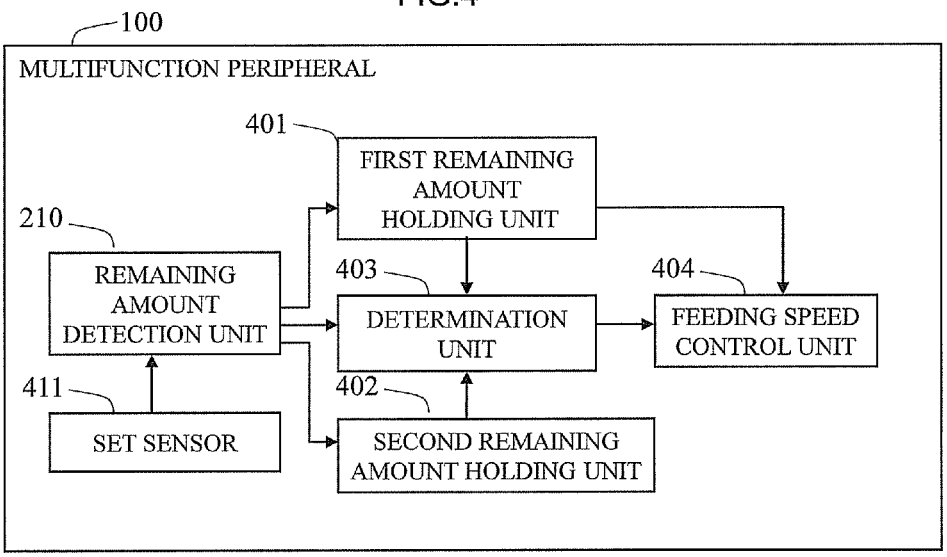
FIG. 4 is a functional block diagram of the multifunction peripheral in accordance with an embodiment of the present disclosure.
FIG. 5 shows an example of a paper adding position determination in accordance with an embodiment of the present disclosure.

FIG. 4 is a functional block diagram of the multifunction peripheral 100 in this embodiment. As shown in FIG. 4, the multifunction peripheral 100 in the embodiment includes a first remaining amount holding unit 401, a second remaining amount holding unit 402, a determination unit 403 and a feeding speed control unit 404.

The first remaining amount holding unit 401 holds the paper remaining amount detected by the remaining amount detection unit 210 before a paper adding operation to the paper stacking surface. The paper adding operation is a series of operation of pulling the paper tray, adding the papers, mounting the paper tray added with the papers to the multifunction peripheral 100. In the embodiment, when the state detected by the remaining amount detection unit 210 has changed, the detection state (the paper remaining amount) after change is held in the first remaining amount holding unit 401. That is to say, the first remaining amount holding unit 401 holds the latest state detected by the remaining amount detection unit 210. Accordingly, when the user starts the paper adding operation, the latest state detected by the remaining amount detection unit 210 is always held in the first remaining amount holding unit 401. In the embodiment, RAM 302 works as the first remaining amount holding unit 401, for example.

The second remaining amount holding unit 402 holds the paper remaining amount detected by the remaining amount detection unit 210 after the paper adding operation to the paper stacking surface. In the embodiment, the second remaining amount holding unit 402 holds the state detected by the remaining amount detection unit 210 at the end of the user's paper adding operation. In the multifunction peripheral 100, the end of the paper adding operation is detected by a set sensor 411. The set sensor 411 detects an opening state that the paper tray is pulled, and a mounting state that the paper tray is mounted. That is to say, when the state detected by the set sensor 411 has changed from the opening state to the mounting state, the state detected by the remaining amount detection unit 210 is held in the second remaining amount holding unit 402. In the embodiment, RAM 3012 works as the second remaining amount holding unit 402, for example.

The set sensor 411 can be configured by using the contactless sensor like the transmissive photo sensor and the reflective type photo sensor, or the contact type sensor like the micro-switches. As long as the state of the paper tray can be detected, the set sensor 411 may be disposed at any position.

The determination unit 403 determines a paper adding position where the papers are added based on both the paper remaining amounts stored in the first remaining amount holding unit 401 and the second remaining amount holding unit 402. It is possible to determine if the papers are added or not by knowing whether the number of papers after the paper adding operation is more or less than that before the paper adding operation. That is to say, when the number of papers reduces after the paper adding operation, the papers are not added because the papers in the paper tray are removed after the tray was pulled. When the number of papers increases after the adding operation, the mounted paper tray is added with the papers. Therefore, at this time if there are the papers in the tray when the paper tray is pulled, it can be considered that the papers are added. In addition, where the detection state by the remaining amount detection unit 210 does not change before and after the adding operation, though it is considered that the paper tray is mounted without adding the papers, but there is a possibility that the papers are added within a range of the resolution for detecting the paper remaining amount by the remaining amount detection unit 210. Therefore, in this case, where there are the papers in the paper tray when the paper tray is pulled, it is determined that the papers are added.

The determination unit 403, when it is determined that the papers are added, determines that the paper remaining amount before the paper tray is pulled is the paper adding position.

FIG. 5 is a table showing an example when the paper adding position is determined by means of a structure shown in FIG. 2B. In the table, "No paper" corresponds to the detection state that the reflective type photo sensors 211 and 212 are OFF, "Level 1" corresponds to the detection state that the reflective type photo sensor 211 is ON and the reflective type photo sensor 212 is OFF, and "Level 2" corresponds to the detection state that the reflective type photo sensor 211 and 212 are ON.

As shown in FIG. 5, when "no paper" before the paper tray is pulled out, there is no preset paper in the paper tray, so that there is no paper adding position in any case of "No paper", "Level 1" or "Level 2" after the paper tray is mounted. Accordingly, the determination unit 403 determines in any case that the papers are not added (no paper adding position).

In case of "Level 1" before the paper tray is pulled out and "No paper" after the paper tray is mounted, the determination unit 403 determines that no paper is added (no paper adding position) because the number of papers reduces. In case of "Level 1" before the paper tray is pulled out and "Level 2" after the paper tray is mounted, the determination unit 403 determines that the papers are added (the paper adding position is "Level 1") because the number of papers increases. In case of "Level 1" before the paper tray is pulled out and "Level 1" after the paper tray is mounted, the determination unit 403 determines that the papers are added (the paper adding position is "Level 1") due to the forgoing reasons.

In case of "Level 2" before the paper tray is pulled out and "No paper" or "Level 1" after the paper tray is mounted, the determination unit 403 determines that no paper is added (no paper adding position) because the number of papers reduces. In case of "Level 2 before the paper tray is pulled out and "Level 2" after the paper tray is mounted, the determination unit 403 determines that the papers are added (the paper adding position is "Level 2") due to the forgoing reasons.

The feeding speed control unit 404 changes the paper feeding speed of the pickup roller 154 based on the paper adding position determined by the determination unit 403 and the paper remaining amount detected by the remaining amount detection unit 210. The paper feeding speed of the pickup roller 154 can be changed by changing the number of revolutions of a motor for driving the pickup roller 154, for example.

It is not limited in particular, but in the embodiment, the feeding speed control unit 404 reduces the paper feeding speed of the pickup roller 154 when the paper remaining amount detected by the remaining amount detection unit 210 comes into a thickness range of papers including the paper adding position determined by the determination unit 403. Additionally, the feeding speed control unit 404 returns the paper feeding speed of the pickup roller 154 to the speed before the reduced speed when the paper remaining amount detected by the remaining amount detection unit 210 goes out the thickness range of papers. For instance, with respect to an example shown in FIG. 5, where "Level 1" before the paper tray is pulled out and "Level 2" after the paper tray is mounted (that is to say, the paper addition position is "Level 1"), when the detection state detected by the remaining amount detection unit 210 is "Level 2", the feeding speed control unit 404 sets the paper feeding speed of the pickup roller 154 to a normal speed. After that, when the state detected by the remaining amount detection unit 210 becomes "Level 1", the feeding speed control unit 404 reduces the paper feeding speed of the pickup roller 154 to a half or three-fourths of the normal speed.

The thickness range of papers including the paper adding position is specified based on the resolution of the remaining amount detection unit 210 for detecting the paper remaining amount and the range where the paper feeding trouble may occur due to the paper addition (a specific range of layers upper and near the actual paper adding position). For example, where the resolution for detecting the paper remaining amount is 20 mm in the stacking direction of the papers and the range where the paper feeding trouble may occur is included in the 20 mm range, the thickness range of papers including the paper adding position becomes the resolution for detecting the paper remaining amount including the paper adding position (a minimum unit of papers that the remaining amount detection unit 210 can detect). In addition, for instance, where the resolution for detecting the paper remaining amount is 1 mm and the range where the paper feeding trouble may occur is 3 mm, the thickness range of papers including the paper adding position becomes a sum of the resolution for detecting the paper remaining amount and the range where the paper feeding trouble may occur.

Figure 6:
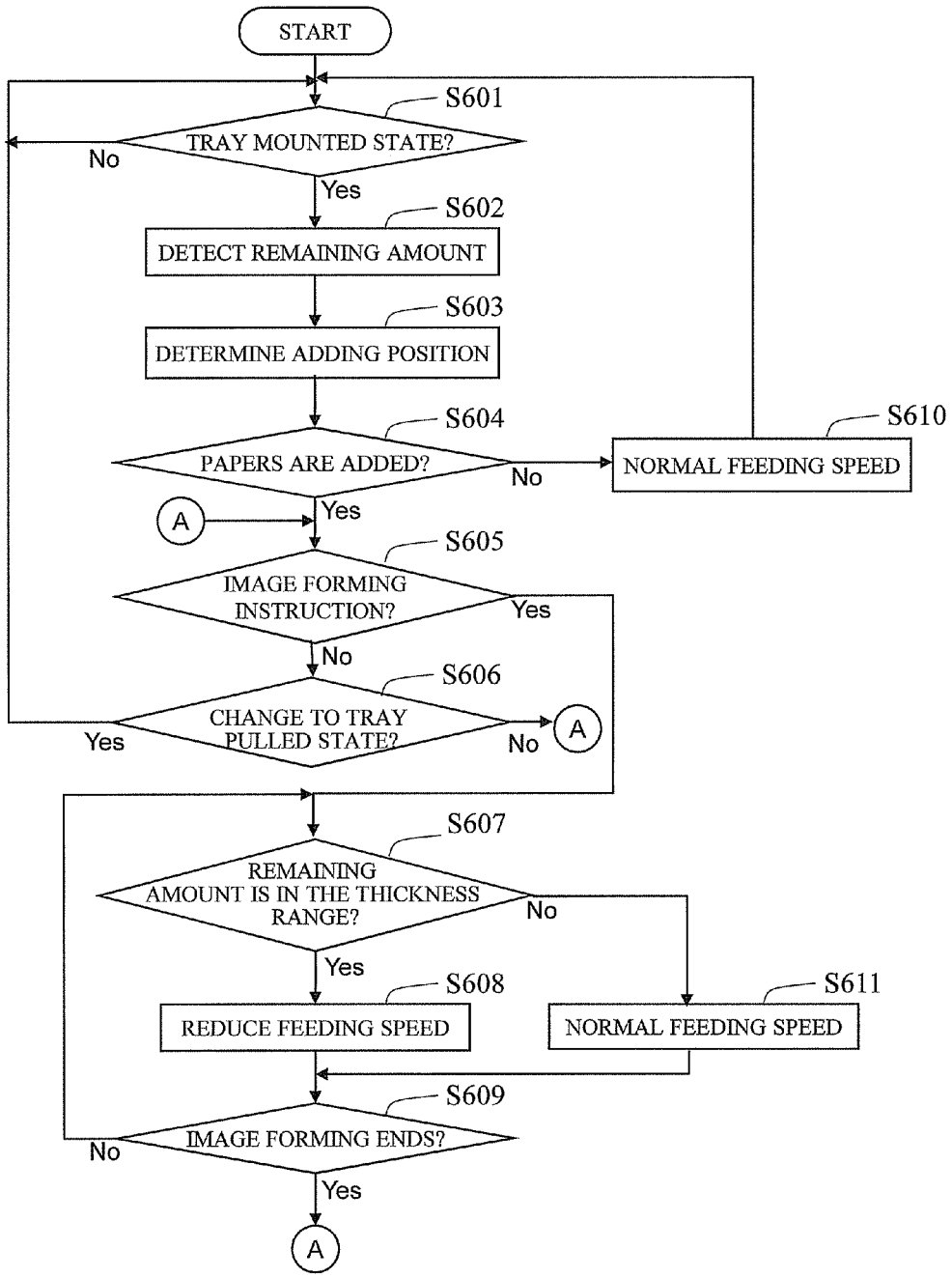
FIG. 6 is a flow chart of a sheet feeding procedure executed by the multifunction peripheral in accordance with an embodiment of the present disclosure.

FIG. 6 is a flowchart showing a paper feed procedure executed by the multifunction peripheral 100. The procedure starts when a main power of the multifunction peripheral 100 is turned on, for example. The procedure goes forwards when the set sensor 411 changes from a tray pulled state to a tray mounted state (Step S601 No, S601 Yes).

When the set sensor 411 of the paper supply device 152 change from the tray pulled state to the tray mounted state, the remaining amount detection unit 210 stores the state detected in the tray mounted states (FIG. 2B, FIG. 2C and FIG. 2D) as mentioned above, that is, the paper remaining amount in the second remaining amount holding unit 402 (Step S602). At this time, the remaining amount detection unit 210 notifies the determination unit 403 of the end of storing the detected state.

Upon receipt of the notification, the determination unit 403 determines whether the papers are added or not and the paper adding position based on each paper remaining amount stored in the first remaining amount holding unit 401 and the second remaining amount holding unit 402, as described above (Step S603). The determination unit 403 notifies the feeding speed control unit 404 of the determination result. It is not limited in particular, where the determination result is that the paper are added, the determination unit 403 notifies the feeding speed control unit 404 of the paper adding position ("Level 1" or "Level 2" in FIG. 5). Where the determination result is that the paper are not added, the determination unit 403 notifies the feeding speed control unit 404 that the papers are not added.

When the determination result that the papers are not added is inputted from the determination unit 403, the feeding speed control unit 404 sets the paper feeding speed of the pickup roller 154 of the paper supply device 152 to the normal speed (Step S604 No, S610). The state is maintained till the set sensor 411 of the paper supply device 152 changes from the tray pulled state to the tray mounted state and the determination unit 403 executes the determination again (Step S601 No, S601 Yes, S602, S603, S604).

On the other hand, when the determination unit 403 inputs the paper adding position, the feeding speed control unit 404 changes the paper feeding speed of the pickup roller 154 based on the inputted paper adding position and the paper remaining amount detected by the remaining amount detection unit 210, as described above. Specifically, when the instruction to form an image is inputted in such state, the feeding speed control unit 404 compares the thickness range of papers including the inputted paper adding position with the latest paper remaining amount of the remaining amount detection unit 210 stored in the first remaining amount holding unit 401 (Step S605 Yes, S607). If the latest remaining amount of the remaining amount detection unit 210 is out of the thickness range of papers including the paper adding position, the feeding speed control unit 404 sets the paper feeding speed of the pickup roller 154 of the paper supply device 152 to the normal speed (Step S607 No, S611). If the latest remaining amount of the remaining amount detection unit 210 is in the thickness range of papers including the paper adding position, the feeding speed control unit 404 sets the paper feeding speed of the pickup roller 154 of the paper supply device 152 to a predetermined speed lower than the normal speed (Step S607 Yes, S608).

The step of comparing the thickness range of papers and the latest paper remaining amount is executed whenever the paper is consumed during the image forming processing (Step S609 No, S607). Therefore, when the latest paper remaining amount changes from out of the thickness range of papers including the paper adding position to within the thickness range of papers during the image forming processing, the feeding speed control unit 404 sets the paper feeding speed of the pickup roller 154 of the paper supply device 152 to the predetermined speed lower than the normal speed (Step S607 Yes, S608). In addition, when the latest paper remaining amount changes from within the thickness range of papers including the paper adding position to out of the thickness range of papers during the image forming processing, the feeding speed control unit 404 sets the paper feeding speed of the pickup roller 154 of the paper supply device 152 to the normal speed (Step S607 No, S611).

When the set sensor 411 changes to the tray pulled state while waiting for the input of the image forming instruction, the above-mentioned steps are executed from the beginning (Step S609 Yes, S605 No, S606 No, S605 No, S606 Yes, S601).

As described above, since the multifunction peripheral 100 is configured that the paper feeding speed of the pickup roller 154 can be changed based on the paper adding position where the paper feeding trouble may occur, it is possible to exactly prevent the occurrence of the feeding trouble at the paper adding position. Since it is configured that the paper feeding speed of the pickup roller 154 can be changed based on the paper adding position where the paper feeding trouble may occur, the paper feeding speed can be set to the normal at a position where the feeding trouble may not occur. It is possible to suppress the reduction of the productivity. Besides, since the paper remaining amount detection unit 210 having the low resolution is employed in the above embodiment, the thickness range of papers including the paper adding position becomes relatively wide. However, where the paper remaining amount detection unit 210 having the high resolution is employed, it is possible to suppress the reduction of the productivity further more. For instance, where the papers in the paper tray is divided into 10 levels and the remaining amount of paper is detected, the thickness range of papers including the paper adding position corresponds to one level of them, and the reduction of the productivity can be suppressed more effectively.

Besides, the above embodiment does not limit the technical range of the present disclosure, and any modification and application can be made within the range of the disclosure in addition to the foregoing embodiment. For instance, the above-mentioned multifunction peripheral 100 was configured that the feeding speed control unit 404 adjusts the feeding speed of the pickup roller 154 at two levels of the normal speed and the lower speed, but the feeding speed may be adjusted at multi levels more than three levels. Specifically, when the latest paper remaining amount detected by the remaining amount detection unit 210 is getting close to the thickness range of papers including the paper adding position, the feeding speed control unit 404 may set the feeding speed of the pickup roller 154 to the speed gradually reducing from the normal speed to the lower speed. Moreover, when the latest paper remaining amount detected by the remaining amount detection unit 210 passes through the thickness range of papers including the paper adding position, the feeding speed control unit 404 may set the feeding speed of the pickup roller 154 to the speed gradually increasing from the lower speed to the normal speed.

In the above-mentioned embodiment, it is configured the lifting plate 201 moves up and down by the biasing force, but the lifting plate 201 may move up and down by a driving means like a motor. In this case, the paper remaining amount is configured so as to be detected by the moving amount of the lifting plate moved by the motor, the resolution for detecting the paper remaining amount can be improved notably. The detection of the paper remaining amount can be carried out together with the consumption amount of papers by the image forming processing.

With respect to the flowchart shown in FIG. 6, the order of steps may be changed adequately if it can provide with the same effect. For instance, it is configured in the above embodiment that, whenever the paper is consumed by the image forming processing, the determination is executed whether or not the latest paper remaining amount is in the thickness range of papers including the paper adding position, however, the determination may be executed at an adequate time, such as only at the start of the image forming processing.

In the forgoing embodiment, the present disclosure is materialized as the paper supply device for the digital multifunction peripheral. It is possible to apply the present disclosure to not only the digital multifunction peripheral but also any image forming apparatus provided with the printer, the copying machine, and the printing function. In addition, the present disclosure can be applied to the sheet supply device for feeding arbitrary sheets except for the papers.

It is possible for the present disclosure to suppress the reduction of the productivity and prevent the occurrence of the feed trouble at the paper adding position, so that the present disclosure is useful as the sheet supply device and the image forming apparatus.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A sheet supply device for feeding a sheet one by one from a plurality of sheets loaded on a sheet stacking surface, the device comprising:

a pickup roller placed above a sheet stacking surface and for feeding each of the sheets by contacting an upper surface of each sheets loaded on the sheet stacking surface;

a remaining amount detection unit for detecting a remaining amount of sheets loaded on the sheet stacking surface;

a first remaining amount holding unit for storing the remaining amount of sheets detected by the remaining amount detection unit before an operation for adding the sheets on the sheet stacking surface;

a second remaining amount holding unit for storing the remaining amount of sheets detected by the remaining amount detection unit after the operation for adding the sheets on the sheet stacking surface;

a determination unit for determining a sheet adding position based on the respective remaining amount of sheets stored in the first remaining amount holding unit and the second remaining amount holding unit; and a feeding speed control unit for changing a sheet feeding speed of the pickup roller based on the sheet adding position determined by the determination unit and the sheet remaining amount detected by the remaining amount detection unit, wherein the feeding speed control unit reduces the sheet feeding speed of the pickup roller when the sheet remaining amount comes into a thickness range of sheets including the sheet adding position determined by the determination unit, and returns the sheet feeding speed of the pickup roller to the speed before the reduced speed when the sheet remaining amount goes out the thickness range of sheets including the sheet adding position determined by the determination unit.

2. The sheet supply device according to claim 1, wherein the thickness range of sheets including the sheet adding position is specified by a resolution of the remaining amount detection unit for detecting the sheet remaining amount and a range where the sheet feeding trouble may occur due to the sheet addition.

3. An image forming apparatus provided with the sheet supply device in claim 2.

4. An image forming apparatus provided with the sheet supply device in claim 1.

* * * * *